US011137171B2

(12) United States Patent
Lesage et al.

(10) Patent No.: US 11,137,171 B2
(45) Date of Patent: Oct. 5, 2021

(54) TRANSCRITICAL R-744 REFRIGERATION SYSTEM FOR SUPERMARKETS WITH IMPROVED EFFICIENCY AND RELIABILITY

(71) Applicant: SYSTEMES LMP INC., Laval (CA)

(72) Inventors: Gaétan Lesage, Blainville (CA); Jordan Kantchev, Longueuil (CA)

(73) Assignee: SYSTEMES LMP INC., Laval (CA)

( * ) Notice: Subject to any disclaimer, the term of this patent is extended or adjusted under 35 U.S.C. 154(b) by 0 days.

(21) Appl. No.: 16/215,774

(22) Filed: Dec. 11, 2018

(65) Prior Publication Data

US 2020/0182515 A1 Jun. 11, 2020

(51) Int. Cl.

| | |
|---|---|
| ***F25B 9/00*** | (2006.01) |
| ***F25B 1/00*** | (2006.01) |
| *F25B 43/00* | (2006.01) |

(52) U.S. Cl.

CPC ..... *F25B 9/008* (2013.01); *F25B 1/00* (2013.01); *F25B 43/00* (2013.01)

(58) Field of Classification Search

CPC .. F25B 9/008; F25B 1/00; F25B 43/00; F25B 43/006; F25B 2309/06

See application file for complete search history.

(56) References Cited

U.S. PATENT DOCUMENTS

| | | | | |
|---|---|---|---|---|
| 6,216,481 | B1 * | 4/2001 | Kantchev | F25B 25/00 62/175 |
| 8,789,380 | B2 * | 7/2014 | Lesage | F25B 7/00 62/81 |
| 2008/0011004 | A1 * | 1/2008 | Lesage | F25B 1/10 62/200 |
| 2013/0298593 | A1 * | 11/2013 | Christensen | F25B 1/10 62/467 |
| 2014/0352343 | A1 * | 12/2014 | Hinde | F25B 47/022 62/277 |
| 2016/0010904 | A1 * | 1/2016 | Kantchev | F25B 9/008 62/114 |

* cited by examiner

*Primary Examiner* — Andrew D St. Clair
(74) *Attorney, Agent, or Firm* — PRAXIS

(57) ABSTRACT

A transcritical R-744 refrigeration system comprising at least one first compressor for compressing an R-744 refrigerant, a gas cooler for cooling the R-744 refrigerant compressed by the at least one first compressor, a throttling device for decreasing the pressure of the cooled R-744 refrigerant, a receiver for separating the R-744 refrigerant, a first heat exchanger for exchanging heat between the cooled R-744 refrigerant and the R-744 vapors separated by the receiver before the R-744 vapors are transported to the at least one first compressor, and an integrated R-744 refrigerant-based air-conditioning assembly comprising a second plurality of compressors and an air conditioner comprising a second heat exchanger and an evaporator, wherein the system is operatable in a dehumidification mode wherein the R-744 vapors exiting the gas cooler are fed through the second heat exchanger to heat and dehumidify the passing ambient air before being fed to the receiver.

9 Claims, 4 Drawing Sheets

TRANSCRITICAL R-744 REFRIGERATION SYSTEM FOR SUPERMARKETS WITH IMPROVED EFFICIENCY AND RELIABILITY

FIELD OF THE INVENTION

The present invention relates to refrigeration systems, and more specifically to transcritical R-744 refrigeration systems for supermarkets having refrigeration, air conditioning, heat reclaim and dehumidifying capabilities.

BACKGROUND OF THE INVENTION

R-744 refrigeration systems are currently used with increased frequency in supermarkets to refrigerate or maintain perishable products or foodstuff in a frozen state. The R-744 refrigerant is environmentally friendly (its global warming potential (GWP) has a value of 1 compared to hydro-fluorocarbon refrigerants with GWP's in the thousands) and is not as expensive as newer hydro-fluorocarbon refrigerants with lower GWP's.

However, the R-744 refrigerant has a very low critical temperature (87.761° F.). As such, during warmer periods of the year when the ambient air temperature is higher, R-744 refrigeration systems operate in their transcritical mode, resulting in no condensation taking place in the gas cooler. In order to obtain liquid refrigerant, the cooled R-744 transcritical vapors are typically fed through a throttling device, thus reducing their pressure and temperature. As a result, a mixture of vapors and liquid is obtained. At an ambient air temperature of, for example, 90° F. and a gas cooler outlet temperature of 95° F., this mixture is composed of approximately 55% liquid and 45% vapor. The percentage of the liquid in the mixture will continue to decrease as the gas cooler outlet temperature increases. In comparison, when a subcritical refrigerant is used, the obtained condensed liquid makes up 100% of the mass flow exiting the compressor. As such, transcritical R-744 refrigeration systems operate with substantially lower energy efficiency ratios (EER) than other refrigerant-based systems.

A number of methods currently exist to improve the EER of transcritical R-744 systems operating in high ambient temperatures. As a first method, vapors leaving the gas cooler can be mechanically subcooled. This method offers the desired efficiency improvements but requires the installation of additional compressors, a heat exchanger and other accessories, which may be costly and time consuming. Another possible method is the usage of an adiabatic or evaporative gas cooler. In a temperate climate, this method would allow the system to operate practically all year in its subcritical mode. There are however some disadvantages to this method. Water for such purposes is not always available and could be expensive to use. Further, the price of an adiabatic gas cooler is considerably higher than that of a typical air-based gas cooler. Finally, additional equipment such as pumps, a water reservoir, filtration means, and water treatment devices must be installed.

SUMMARY OF THE INVENTION

It is therefore a general object of the present invention to provide a transcritical R-744 refrigeration system with a higher energy efficiency ratio.

It is a further object of the present invention to provide a transcritical R-744 refrigeration system with improved reliability.

It is a further object of the present invention to provide a method for increasing the energy efficiency ratio of a transcritical R-744 refrigeration system through the use of the system's dehumidification capabilities.

Another object of the present invention is to improve the energy efficiency ratio of a transcritical R-744 refrigeration system while avoiding the installation of additional heat exchangers, the installation of refrigeration compressors or the use of water.

In order to address the above and other drawbacks, there is provided a transcritical R-744 refrigeration system, the system comprising at least one first compressor for compressing an R-744 refrigerant, a gas cooler for cooling the R-744 refrigerant compressed by the at least one first compressor, a throttling device for decreasing the pressure of the R-744 refrigerant cooled by the gas cooler, a receiver for separating the R-744 refrigerant into liquid R-744 and R-744 vapors, a first heat exchanger for exchanging heat between the R-744 refrigerant cooled by the gas cooler and the R-744 vapors from evaporators 30 and the R744 vapors separated by the receiver before the R-744 vapors are transported to the at least one first compressor, and an integrated R-744 refrigerant-based air-conditioning assembly comprising a second plurality of compressors and an air conditioner comprising a second heat exchanger and an evaporator, wherein the system is operatable in a dehumidification mode wherein the R-744 vapors exiting the gas cooler are fed through the second heat exchanger to heat and dehumidify the passing ambient air before being fed to the receiver.

In an embodiment, the system is operatable in a heat reclaim mode wherein the R-744 vapors compressed by the at least one first compressor are fed to a third heat exchanger to evaporate the liquid R-744 from the receiver before being fed to the gas cooler, the evaporated liquid R-744 being fed to and compressed by the second plurality of compressors before being fed the second heat exchanger to heat passing ambient air and then to the gas cooler.

In an embodiment, the system is operatable in an air conditioning mode wherein the liquid R-744 from the receiver is fed through the evaporator to cool the passing ambient air before being fed through and compressed by the second plurality of compressors and then fed to the gas cooler.

In an embodiment, the system further comprises at least one bypass valve for controlling the flow of the R-744 vapors flowing through the heat exchanger 21 to achieve a desired inlet temperature at the at least one first compressor.

In an embodiment, the system further comprises a pressure regulating valve for regulating the pressure of the R-744 vapors after passing through the receiver.

In an embodiment, the pressure regulating valve is a flash gas bypass valve.

In an embodiment, the system further comprises a modulating valve for modulating the flow of the R-744 vapors compressed by the at least one first compressor being fed to the third heat exchanger.

The present disclosure also provides a method for operating a transcritical R-744 refrigeration system, the method comprising the steps of compressing an R-744 refrigerant by at least one first compressor, cooling the R-744 refrigerant at a gas cooler, decreasing the pressure of the R-744 refrigerant at a throttling device, separating the R-744 refrigerant into liquid R-744 and R-744 vapors at a receiver, exchanging heat between the R-744 refrigerant cooled by the gas cooler and the R-744 vapors from evaporators 30 and the R744 vapors separated by the receiver at a first heat exchanger, transporting the R-744 vapors from the first heat exchanger to the at least one first compressor, in a heat reclaim mode, feeding the R-744 vapors compressed by the at least one first compressor to a third heat exchanger to evaporate the liquid R-744 from the receiver before being fed to the gas cooler, then feeding the evaporated liquid R-744 to a second plurality of compressors in an integrated R-744 refrigerant-based air-conditioning assembly, the second plurality of compressors compressing the evaporated liquid R-744, and then feeding the compressed evaporated liquid R-744 to a second heat exchanger in the integrated R-744 refrigerant-based air-conditioning assembly to heat passing ambient air, in an air conditioning mode, feeding the liquid R-744 from the receiver through an evaporator in the integrated R-744 refrigerant-based air-conditioning assembly to cool the passing ambient air, then feeding the liquid R-744 to the second plurality of compressors, the second plurality of compressors compressing the evaporated liquid R-744, and in a dehumidification mode, feeding the R-744 vapors exiting the gas cooler through the second heat exchanger to heat and dehumidify the passing ambient air.

The present disclosure also provides a transcritical R-744 refrigeration system, the system comprising at least one first compressor, the at least one first compressor compressing an R-744 refrigerant, a gas cooler, the gas cooler cooling the R-744 refrigerant compressed by the at least one first compressor, a throttling device, the throttling device decreasing the pressure of the R-744 refrigerant cooled by the gas cooler, a receiver, the receiver separating the R-744 refrigerant into liquid R-744 and R-744 vapors, a first heat exchanger, the first heat exchanger exchanging heat between the R-744 refrigerant cooled by the gas cooler and the R-744 vapors separated by the receiver before the R-744 vapors are transported to the at least one first compressor, an external air-conditioning assembly, the external air-conditioning assembly operable using a second refrigerant, an air conditioner comprising a second heat exchanger and an evaporator, wherein the system is operatable in a dehumidification mode wherein the R-744 vapors exiting the gas cooler are fed through the second heat exchanger to heat and dehumidify the passing ambient air before being fed to the receiver.

In an embodiment, the system is operatable in a heat reclaim mode wherein the R-744 vapors compressed by the at least one first compressor are fed to the second heat exchanger to heat passing ambient air and then fed to the gas cooler.

In an embodiment, the system is operatable in an air conditioning mode wherein the second refrigerant from the external air-conditioning assembly is fed through the evaporator to cool the passing ambient air.

DETAILED DESCRIPTION OF THE ILLUSTRATIVE EMBODIMENTS

Figure 1:
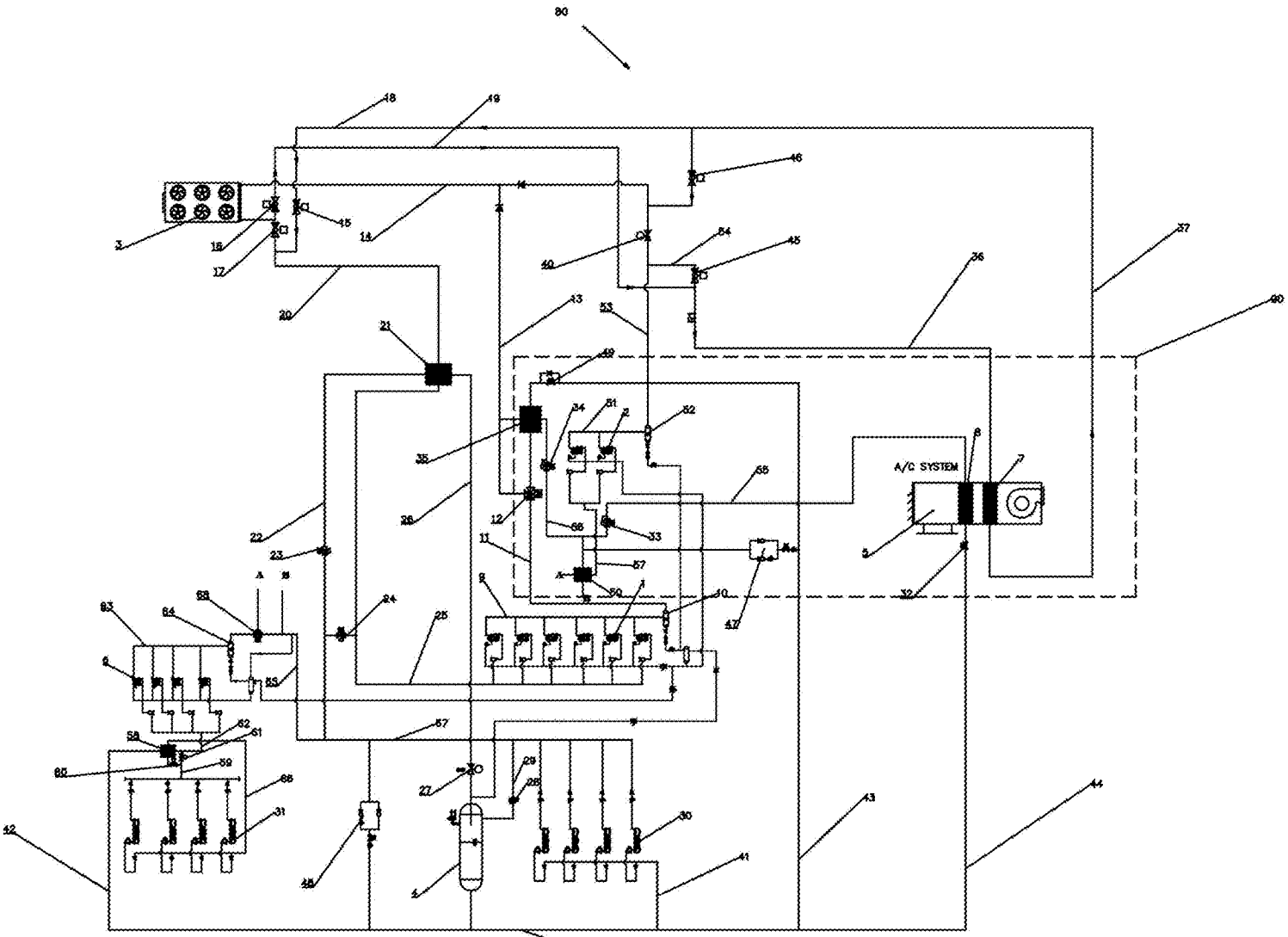
FIG. 1 is a schematic diagram of a transcritical R-744 refrigeration system with refrigeration, air-conditioning and dehumidification capabilities wherein the air-conditioning system is a R-744 refrigeration system incorporated into the main refrigeration system, in accordance with an illustrative embodiment of the present invention.

Referring to FIG. 1, there is shown a transcritical R-744 refrigeration system, generally referred to using the reference numeral 80, to which an R-744 refrigerant-based air-conditioning assembly 90, illustratively a heat pump system, is included as an integral part of system 80, in accordance with an embodiment of the present invention. R-744 vapors compressed by a plurality of compressors 1 are fed through conduit 9, oil separator 10, conduit 11, and modulating valve 12 towards either heat exchanger 35 when the system 80 is operating in a heat reclaim mode (as discussed in further detail below) or directly to conduit 13 when heat reclaim is not required. The R-744 vapors are then fed through conduits 13, 14 before being fed to gas cooler 3 where they are cooled. The cooled R-744 transcritical vapors are then fed through conduit 20, heat exchanger 21, conduit 26 and throttling device 27 to receiver 4, illustratively a flash tank, where a separation of R-744 vapors and liquid occurs. Before re-entering the compressors 1 through conduit 25, the R-744 refrigerant travels through conduit 22 and passes through heat exchanger 21 where it undergoes heat transfer with the R-744 vapors exiting the gas cooler 3, thus maintaining the temperature of the R-744 entering compressors 1 at a required level. Bypass valves 23, 24 control the flow of the R-744 vapors flowing through the heat exchanger 21 in order to achieve the desired inlet temperature at the compressors 1. If this inlet temperature is higher than required, cooling may be provided by liquid injectors 48. After separation in receiver 4, the R-744 vapors are fed through a pressure regulating valve 28, for example a flash gas bypass valve, and conduit 29 to the suction of the compressors 1.

Still referring to FIG. 1, the liquid R-744 refrigerant from receiver 4 is fed through conduits 39, 41 to medium temperature evaporators 30. In evaporators 30, the R-744 refrigerant is evaporated, and these vapors are then fed to compressors 1 either through conduit 67, valve 23, conduit 22, heat exchanger 21 and conduit 25 or through conduit 67, valve 24 and conduit 25. Liquid R-744 refrigerant is also fed from receiver 4 through conduits 39, 42, heat exchanger 58 and conduit 66 to low temperature evaporators 31. In evaporators 31, the R-744 refrigerant is evaporated, and these vapors are then fed through conduit 59, heat exchanger 58 and conduit 62 to the suction ports of a low temperature compressor 6. Valve 61 modulates the flow of the R-744 vapors through the heat exchanger 58, thus maintaining the temperature of the R-744 vapors within the required limits. The R-744 vapors are compressed by compressors 6 and then fed through conduit 63, oil separator 64, valve 68 and conduit 65 to conduit 67 and to the suction compressors 1.

Still referring to FIG. 1, system 80 may comprise an integrated R-744 refrigerant-based air-conditioning assembly 90 comprising a second plurality of compressors 2 and an air conditioner 5 comprising heat exchanger 7 and evaporator 8. Assembly 90 is used for air conditioning during the warmer periods of the year and may be used as a heat pump to extract the rejected heat of the main refrigeration system 80 during the colder periods of the year when comfort heating of the building is required. As such, during the colder periods of the year when heating of the building is required, the compressed hot R-744 vapors from compressors 1 are fed through conduits 9, 11 and modulating valve 12 to heat exchanger 35. Heat exchanger 35 is then connected through valve 34, conduit 56, heat exchanger 50, and conduit 57 to the suction ports of compressors 2, whereas valve 33 is closed. Heat exchanger 35 also receives liquid R-744 fed from receiver 4 through conduits 39, 43 and then to the expansion valve 49 connected to heat exchanger 35. The liquid R-744 refrigerant in heat exchanger 35 absorbs the heat from the R-744 vapors compressed by compressors 1, thus evaporating the liquid R-744 refrigerant. The newly evaporated R-744 vapors are then compressed by compressors 2 and fed through conduit 51, oil separator 52, conduits 53, 54, valve 45 and conduit 36 to heat exchanger 7, situated in air conditioner 5, where a heat transfer between the hot R-744 vapors compressed by compressors 2 and the ambient air of the building occurs, thus providing comfort heating. From heat exchanger 7, the cooled vapors or mixture of vapors and liquid are fed through conduit 37, valve 46 and conduit 14 to gas cooler 3. Pressure regulating valve 40 controls the discharge pressure of compressors 2 at a level necessary for obtaining maximum efficiency of the process.

Still referring to FIG. 1, in order to maintain the suction temperature of compressors 2 within their required temperature limits, hot R-744 vapors can be fed through valve 68 and conduit A to heat exchanger 50. After heat exchange, the cooled R-744 vapors are fed through conduit B to conduit 65.

Still referring to FIG. 1, In heat reclaim mode the statuses of the various directional and modulating valves are as follows. Modulating valve 12 modulates the flow of the R-744 vapors compressed by compressors 1 in order to ensure a stable heat transfer process in heat exchanger 35. Expansion valve 49 is operational. Valves 17, 34, 45, 46 are open. Valve 40 is operational and controls the discharge pressure of compressors 2. Valves 15, 16, 32, 33 are closed. Heat exchanger 50 and liquid injectors 47 maintain the suction temperature of compressors 2 at the required level.

Still referring to FIG. 1, during the colder periods of the year when heat reclaim is required, it may be advantageous to operate the main refrigeration system 80 in subcritical mode, thus with a higher efficiency ratio. However, the rejected heat from the R-744 refrigeration system 80 operating in subcritical mode is at a relatively low temperature and is therefore not suitable for direct heat transfer with the ambient air from the building. In order to obtain rejected heat at a usable temperature, the main refrigeration system 80 must operate in transcritical mode even if subcritical operation is possible, thus considerably reducing the energy efficiency of the system 80. As such, in an embodiment, the present disclosure provides a system and a method for heat reclaim with a high efficiency ratio, whereby the heat pump compressors are operating at a high evaporating temperature (for example 40° F.) while the main refrigeration evaporation temperature is 20° F. and the main refrigeration system is operating in subcritical mode.

Still referring to FIG. 1, during the warmer periods of the year when air conditioning is required, liquid R-744 refrigerant from receiver 4 is fed through conduits 39, 44 to expansion valve 32 connected to evaporator 8, where the ambient air passing through air conditioner 5 is cooled as it transfers heat to the liquid R-744, thus providing air conditioning for the building. Then, the newly evaporated R-744 vapors pass through conduit 55, valve 33, heat exchanger 50 and conduit 57 to the suction ports of compressor 2. The R-744 vapors are compressed by compressor 2 then directed towards gas cooler 3, as above. Valve 34 is closed throughout this process.

Still referring to FIG. 1, for supermarkets it is very important to maintain the relative humidity of the air surrounding the refrigeration cases at a level of 40% to 45% to avoid frost buildup on the foodstuff and to limit the number of required defrost cycles, both resulting in reduced efficiency of the refrigeration system 80 and undesirable temperature changes of the foodstuff. The desired relative humidity cannot be achieved solely by cooling the air with the air conditioner 5. In fact, the air leaving the air conditioning evaporator 8 must be reheated to achieve the desired relative humidity. Typically, electrical or gas heaters may be installed, or the existing heat reclaim system (high pressure hot R-744 vapors from the discharge ports of the compressors) may be used to provide the necessary heat for reheating the air leaving the air conditioning evaporator 8. These methods achieve the required relative humidity but do not increase the energy efficiency of a transcritical R-744 refrigeration system, as the temperature of the R-744 vapors leaving the gas cooler stays unchanged, being governed only by the outside air temperature. As such, in an embodiment, the present disclosure provides a system and method for dehumidifying the interior space of a supermarket to improve the energy efficiency of the refrigeration system without requiring the installation of additional compressors or heat exchangers.

Still referring to FIG. 1, when dehumidification is required, compressor 2 are operatively connected to the air conditioner 5. The compressed R-744 vapors from compressors 2 are fed through conduit 51, oil separator 52, conduit 53, valve 40 and conduit 14 to gas cooler 3. In dehumidification mode, the status of the various directional and modulating valves is as follows. Valve 40 is fully open. Valve 33 is open. Valve 34 is closed. Expansion valve 49 is closed. Valves 45 and 46 are closed. Valves 15 and 16 are opened. Valve 17 is closed. Valve 12 is closed towards heat exchanger 35. The compressed R-744 vapors from compressors 1 are fed through conduit 9, oil separator 10, conduit 11, valve 12, conduits 13, 14 to gas cooler 3. The R-744 vapors from the outlet of the gas cooler 3, which during the warmer periods of the year have a temperature ranging from roughly 90° F. to 100° F. depending on the ambient air temperature, are fed through valve 16 and conduits 19, 36 to heat exchanger 7. At heat exchanger 7, there is a heat transfer between the R-744 vapors from the outlet of gas cooler 3 and the air passing through air conditioner 5. This subcooling of the R-744 vapors results in a significant drop of the temperature of the R-744 vapors, for example a drop of 15° F. to 25° F., and an increase in temperature of the air passing through air conditioner 5. As a person of ordinary skill in the art would understand, an increase in air temperature results in a decrease in its relative humidity as long as no moisture is added to the air. As such, the relative humidity of the air leaving the air conditioner 5 is thus reduced to the required level. From heat exchanger 7, the cooled R-744 vapors are fed through conduits 37, 18, valve 15, and conduit 20 through heat exchanger 21 and then through conduit 26 to throttling device 27 and receiver 4.

Figure 2:
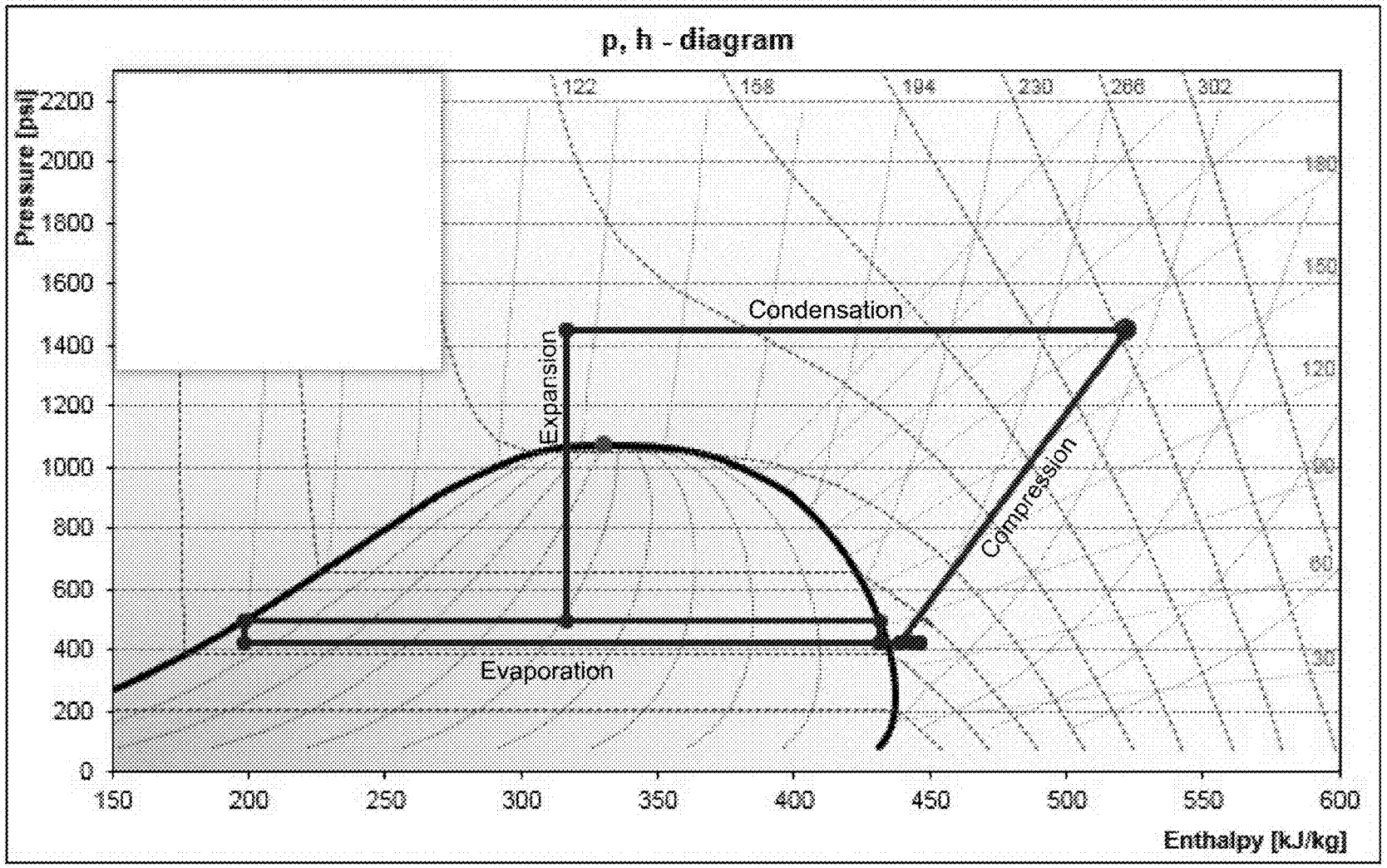
FIG. 2 is a pressure-enthalpy (P-H) diagram of the functioning of a traditional R-744 refrigeration system operating at a high ambient temperature.

Referring now to FIG. 2, there is shown a pressure-enthalpy (P-H) diagram representing the refrigeration process of a typical transcritical R-744 refrigeration system operating at an ambient air temperature of about 95° F. wherein the temperature of the R-744 vapors at the outlet of the gas cooler is 100° F. In this case, only 52% of the mass flow of the transcritical compressors is converted to liquid after passing through a throttling device. As such, the energy efficiency ratio, comparing refrigeration capacity to power consumption, is in the region of 5.6 (btu/hr)/watts.

Figure 3:
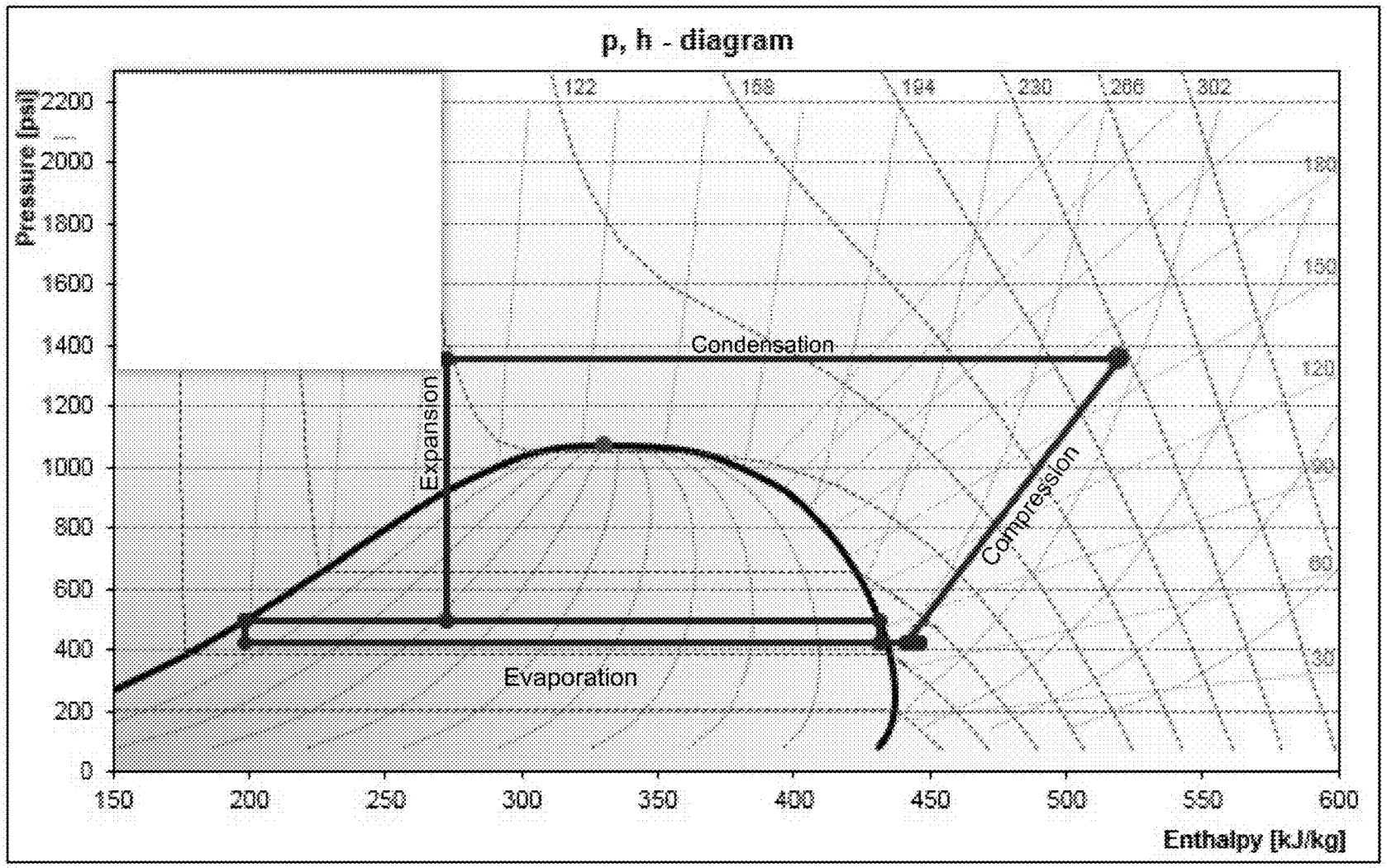
FIG. 3 is a pressure-enthalpy (P-H) diagram of the functioning of a transcritical R-744 refrigeration system operating at a high ambient temperature with the system's dehumidification capabilities being utilized.

Referring now to FIG. 3 in addition to FIGS. 1 and 2, there is shown a P-H diagram representing the refrigeration process of transcritical refrigeration system 80 operating at an ambient air temperature of about 95° F. wherein the temperature of the R-744 vapors at the outlet of the gas cooler 3 is 100° F., and wherein the refrigeration system's 80 dehumidification system is in operation. As a person of ordinary skill in the art would understand, by passing the R-744 vapors through heat exchanger 7 after gas cooler 3 and thus reducing their temperature even further (subcooling), they will enter the throttling device for the expansion phase at a lower enthalpy, and thus will be closer to the saturated liquid curve. As such, the ratio of liquid-to-vapor R-744 will increase, thus increasing efficiency. Illustratively, assuming the additional step of dehumidification leads to a temperature drop of the R-744 vapors of roughly 15° F. compared to when they exited the gas cooler 3 is, 68% of the mass flow of the transcritical compressors will have converted to liquid after passing through the throttling device 27, which represents a 30% improvement over the refrigeration system without dehumidification shown in FIG. 2. The energy efficiency of transcritical refrigeration system 80 shown in FIG. 3 is in the region of 7.3 (btu/hr)/watts, which also represent improvement of 30%. The refrigeration capacity of transcritical system 80 is also increased by 30%. It is thus evident that the present disclosure provides a system and method for dehumidification of the interior space of a supermarket which, without requiring the installation of additional compressors and heat exchangers and without additional power consumption, not only achieves the required results regarding the relative humidity but also improve considerably the energy efficiency of the main R-744 transcritical refrigeration system 80.

Figure 4:
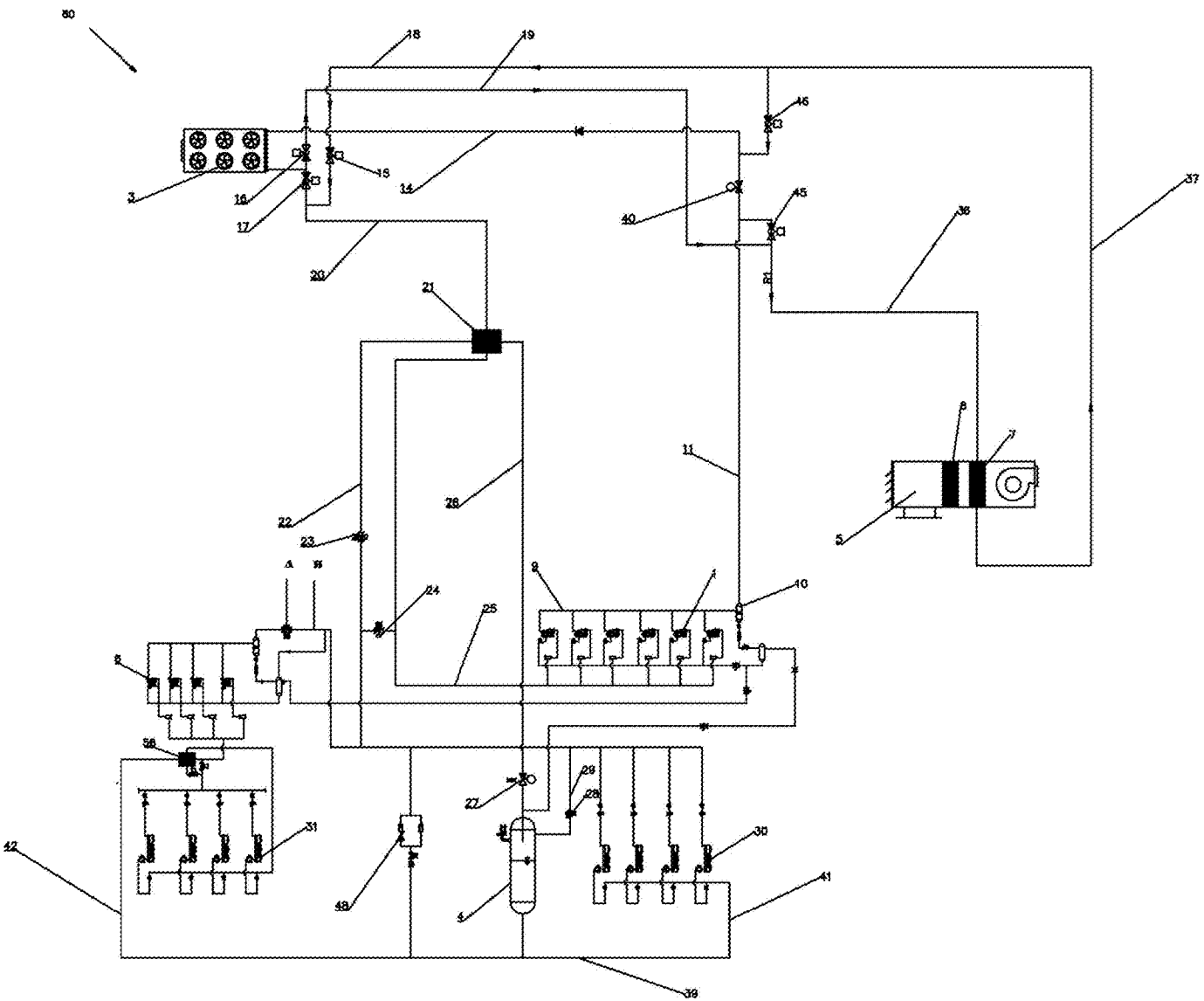
FIG. 4 is a schematic diagram of a transcritical R-744 refrigeration system with refrigeration, air-conditioning and dehumidifying capabilities wherein the air-conditioning system is not an integral part of the main refrigeration system and operates with a non-R-744 refrigerant, in accordance with an illustrative embodiment of the present invention.

Referring to FIG. 4, in an alternate embodiment, transcritical R-744 refrigeration system 80 operates in a similar fashion to the system 80 shown in FIG. 1 and described above, except the air conditioning system (not shown) is not an integral part of the main refrigeration system 80 and uses a refrigerant other than R-744. During the cold periods of the year, the heat reclaim function is provided by the main transcritical R-744 system 80. The status of the modulating valves in this mode is as follows. Valve 40 is operational and maintains the required pressure for effective heat reclaim. Valves 45, 46 are open. Valves 15, 16 are closed. Valve 17 is opened. The hot R-744 vapors compressed by compressors 1 are fed though conduit 9, oil separator 10, conduit 11, valve 45 and conduit 36 to the heat reclaim heat exchanger 7, where a heat transfer between the hot R-744 vapors compressed by compressors 1 and the ambient air of the building occurs, thus providing comfort heating. From heat exchanger 7, the cooled R-744 vapors or mixture of vapors and liquid are fed through conduit 37, valve 46 and conduit 14 to the gas cooler 3. During the warm periods of the year, the compressors (not shown) providing the necessary refrigeration capacity for the air conditioning of the supermarket building are connected to the air conditioning evaporator 8. The evaporation of liquid refrigerant in evaporator 8 absorbs the heat from the ambient air circulated through air conditioner 5, thus providing air conditioning for the building.

Still referring to FIG. 4, when dehumidification is required, the statuses of the directional and modulating valves is as follows. Valve 40 is fully open. Valves 45, 46 are closed. Valves 15, 16 are opened. Valve 17 is closed. The compressed R-744 vapors from compressors 1 are fed through conduit 9, oil separator 10, conduit 11, valve 40, and conduit 14 to gas cooler 3. The R-744 vapors from the outlet of the gas cooler 3, which during the warmer periods of the year have a temperature ranging roughly from 90° F. to 100° F. depending on the ambient air temperature, are fed through valve 16, conduit 19 and conduit 36 to the heat exchanger 7 where a heat transfer between the R-744 vapors from the outlet of gas cooler 3 and the ambient air leaving air conditioner 5 occurs, resulting in a significant drop of the temperature of the R-744 vapors (a drop of roughly 15° F. to 25° F.). The relative humidity of the air leaving the air conditioner is thus reduced to the required level. From heat exchanger 7, the cooled R-744 vapors are fed through conduits 37, 18, valve 15, and conduit 20 through heat exchanger 21 and then through conduit 26 to throttling device 27 and receiver 4.

The scope of the claims should not be limited by the preferred embodiments set forth in the examples, but should be given the broadest interpretation consistent with the description as a whole.

The invention claimed is:

1. A transcritical R-744 refrigeration system (80), the system (80) comprising:

at least one first compressor (1) for compressing an R-744 refrigerant from at least one first evaporator (30);

a gas cooler (3) for cooling said R-744 refrigerant compressed by said at least one first compressor (1);

a throttling device (27) connecting to said gas cooler (3) and decreasing a pressure of said R-744 refrigerant cooled by said gas cooler (3);

a receiver (4) for separating said R-744 refrigerant into liquid R-744 and R-744 vapors, said receiver (4) feeding said at least one first evaporator (30) with said liquid R-744;

a first heat exchanger (21) for exchanging heat between said R-744 refrigerant cooled by said gas cooler (3) and said R-744 vapors separated by said receiver (4) before said R-744 vapors are transported to said at least one first compressor (1) through said at least one first evaporator (30); and an air-conditioning assembly (90) being integrated with the system (80) and comprising an air conditioner (5) including a second heat exchanger (7) and a second evaporator (8), and at least one second compressor (2) for compressing said R-744 refrigerant from said second evaporator (8);

wherein the system (80) is operatable in a dehumidification mode wherein said R-744 vapors exiting said gas cooler (3) are fed through said second heat exchanger (7) to heat and dehumidify ambient air passing through said second heat exchanger (7) before being fed to said receiver (4).

2. The transcritical R-744 refrigeration system (80) of claim 1, wherein the system (80) is operatable in a heat reclaim mode wherein said R-744 vapors compressed by said at least one first compressor (1) are fed to a third heat exchanger (35) to evaporate said liquid R-744 from said receiver (4) before being fed to said gas cooler (3), said evaporated liquid R-744 being fed to and compressed by said at least one second compressor (2) before being fed to said second heat exchanger (7) to heat said ambient air passing through said second heat exchanger (7) and then to said gas cooler (3).

3. The transcritical R-744 refrigeration system (80) of claim 1, wherein the system (80) is operatable in an air conditioning mode wherein said liquid R-744 from said receiver (4) is fed through said second evaporator (8) to cool ambient air passing through said second evaporator (8) before being fed through and compressed by said at least one second compressor (2) and then fed to said gas cooler (3).

4. The transcritical R-744 refrigeration system (80) of claim 1, further comprising at least one bypass valve (23, 24) for controlling the flow of said vapors flowing through said first heat exchanger 1211 to achieve a desired inlet temperature at said at least one first compressor (1).

5. The transcritical R-744 refrigeration system (80) of claim 1, further comprising a pressure regulating valve (28) for regulating the pressure of said R-744 vapors after passing through said receiver (4).

6. The transcritical R-744 refrigeration system (80) of claim 5, wherein said pressure regulating valve (28) is a flash gas bypass valve.

7. The transcritical R-744 refrigeration system (80) of claim 1, further comprising a modulating valve (12) for modulating a flow of said R-744 vapors compressed by said at least one first compressor (1) and being fed to a third heat exchanger (35).

8. The transcritical R-744 refrigeration system (80) of claim 1, wherein the system (80) is operatable in a heat reclaim mode wherein said R-744 vapors compressed by said at least one first compressor (1) are fed to said second heat exchanger (7) to heat passing ambient air and then fed to said gas cooler (3).

9. The transcritical R-744 refrigeration system (80) of claim 1, wherein the air-conditioning assembly (90) is external to the system (80) and wherein the system (80) is operatable in an air conditioning mode wherein said second refrigerant from said external air-conditioning assembly is fed through said evaporator (8) to cool said passing ambient air.

* * * * *